US006457848B1

(12) United States Patent
Wolf et al.

(10) Patent No.: US 6,457,848 B1
(45) Date of Patent: Oct. 1, 2002

(54) SNAP TOGETHER DOWN LIGHT FIXTURE

(75) Inventors: David Wolf, Brooklyn, NY (US); Eugene Diaconu, Bensalem, PA (US)

(73) Assignee: Nutech Lighting Corp., Bronx, NY (US)

( * ) Notice: Subject to any disclaimer, the term of this patent is extended or adjusted under 35 U.S.C. 154(b) by 0 days.

(21) Appl. No.: 09/654,151

(22) Filed: Sep. 1, 2000

(51) Int. Cl.[7] ..... F21V 17/00

(52) U.S. Cl. ..... 362/364; 362/365; 362/366; 362/368; 362/148; 362/455; 248/343

(58) Field of Search ..... 362/364, 365, 362/366, 352, 368, 148, 226, 455; 248/343

(56) References Cited

U.S. PATENT DOCUMENTS

| | | | | | |
|---|---|---|---|---|---|
| 4,297,525 | A | | 10/1981 | Bowden, Jr. | |
| 4,304,957 | A | | 12/1981 | Slater | |
| 4,332,330 | A | | 6/1982 | Lockwood | |
| 5,374,812 | A | * | 12/1994 | Chan | 362/364 |
| 5,434,359 | A | | 7/1995 | Schnell | |
| 5,567,041 | A | * | 10/1996 | Slocum | 362/365 |
| 5,603,424 | A | | 2/1997 | Bordwell | |
| 5,609,414 | A | * | 3/1997 | Caluori | 362/366 |
| 5,673,997 | A | * | 10/1997 | Akiyama | 362/365 |
| 5,909,955 | A | * | 6/1999 | Roorda | 362/364 |
| 5,964,523 | A | * | 10/1999 | Everberg | 362/365 |
| 6,000,818 | A | * | 12/1999 | Caluori | 362/365 |
| 6,116,758 | A | * | 9/2000 | Lin | 362/364 |
| 6,132,069 | A | * | 10/2000 | Sato | 362/368 |
| 6,170,685 | B1 | | 1/2001 | Currier | |

* cited by examiner

*Primary Examiner*—Stephen Husar
*Assistant Examiner*—Guiyoung Lee
(74) *Attorney, Agent, or Firm*—Katten Muchin Zavis Rosenman

(57) ABSTRACT

A down light fixture is assembled from parts that are substantially snap engageable and is installed through a ceiling orifice and supported by the ceiling without requiring permanent attachment to an existent support beam or the like. The light fixture comprises a can adapted to receive a lighting unit and installable through the ceiling orifice from its exposed side, and a decorative trim member removably and securely engageable with the can. The can is further provided with a flange on its free end that is positioned adjacent the exposed surface of the ceiling about the insertion orifice after the can has been inserted into the ceiling therethrough. The decorative trim member is rotatingly, removably and securely engageable with the flange to provide an exterior trim to the fixture. Several parts of the lighting fixture are removable and replaceable to vary the appearance of the light fixture without removal of such fixture from the ceiling.

18 Claims, 9 Drawing Sheets

SNAP TOGETHER DOWN LIGHT FIXTURE

FIELD OF THE INVENTION

This invention relates to light fixtures in general, and in particular to a so-called down light fixture installable in a ceiling from below and formed mostly from pieces that are snapped together.

BACKGROUND OF THE INVENTION

Recessed lighting fixtures can be fairly complicated in both their manufacture and installation. A single lighting fixture is usually formed from several parts that are fixed or semi-permanently connected and presented to a consumer as an installable unit. The consumer usually doesn't care how the unit is manufactured, as long as it can be located in a ceiling and attached to a power source.

In most situations, the consumer purchases a specific lighting fixture to match a specific environment or decor. A change in decor usually necessitates the purchase of a new lighting fixture. In addition, the selection of lighting fixtures, particularly when adding to an existing ceiling, is usually limited by the type or adequacy of ceiling support. Certain lighting fixtures require a permanent attachment to a structural support beam of some kind already situated within the ceiling. Furthermore, the ability to vary the appearance of the lighting fixture once installed is usually very difficult, requiring the disassembly or complete removal of the fixture from the ceiling. Thus, there are a variety of limitations a consumer must consider when purchasing a lighting fixture currently on the market.

From a manufacturing perspective, complicated assemblies usually translate into increased costs to the consumer as a result of elaborate machinery and/or increased labor costs. Problems with permanent or semi-permanent connections are difficult to rectify, and lighting fixtures that employ such connections become vulnerable if one integral component breaks down or fails. In addition, lighting fixtures that are installable in a variety of environments must be equipped with the means to achieve such installation, which usually requires an assortment of fasteners and mounting assemblies. Thus, lighting fixtures that require permanent or semi-permanent connections, that are not easily varied in their appearance, and that must be adapted for installation in a variety of environments provide the consumer with a product that is unnecessarily expensive, complicated in construction and is aesthetically and functionally limited.

There is a need, therefore, for a light fixture that is simple and inexpensive to manufacture, easy to install and operate and variable in its presentation.

OBJECTS OF THE INVENTION

It is an object of the present invention, therefore, to provide a light fixture that is easy to manufacture and simple to assemble.

It is a further object of the present invention to provide a light fixture that is variable in presentation depending on the environment in which the fixture is installed.

It is a still further object of the present invention to provide a light fixture that is assembled from parts using substantially non-permanent connections.

It is a still further object of the present invention to provide a light fixture that has a decorative trim piece that is easily and removably attached to the light fixture once situated in the ceiling.

It is a further object of the present invention to provide a light fixture that is installable in a variety of ceiling environments and not necessarily limited by the adequacy of existent ceiling support.

Still other objects and advantages of the invention will become clear upon review of the following detailed description in conjunction with the appended drawings.

SUMMARY OF THE INVENTION

A down light fixture is formed from a plurality of parts that are substantially snap engageable, thereby simplifying assembly and requiring few or no tools. The fixture is installable from below through a ceiling orifice and supportable by the ceiling alone, without requiring permanent attachment to an existent support beam. The primary components of the light fixture include a can adapted to receive a lighting unit, such can being installable through a ceiling orifice from its exposed side, and a decorative trim member that is removably and securely engageable with the can. The can is retained in the ceiling by retaining members and is further provided with a flange on its free end. The flange is positioned adjacent the exposed surface of the ceiling about the insertion orifice after the can is inserted into the ceiling through such orifice. The decorative trim member is rotatingly, removably and securely engageable with the flange to provide an exterior trim to the fixture. Such decorative trim member is removable and replaceable with other trim members to vary the appearance of the light fixture without removal thereof from the ceiling.

DETAILED DESCRIPTION OF THE PREFERRED EMBODIMENTS

Figure 1:
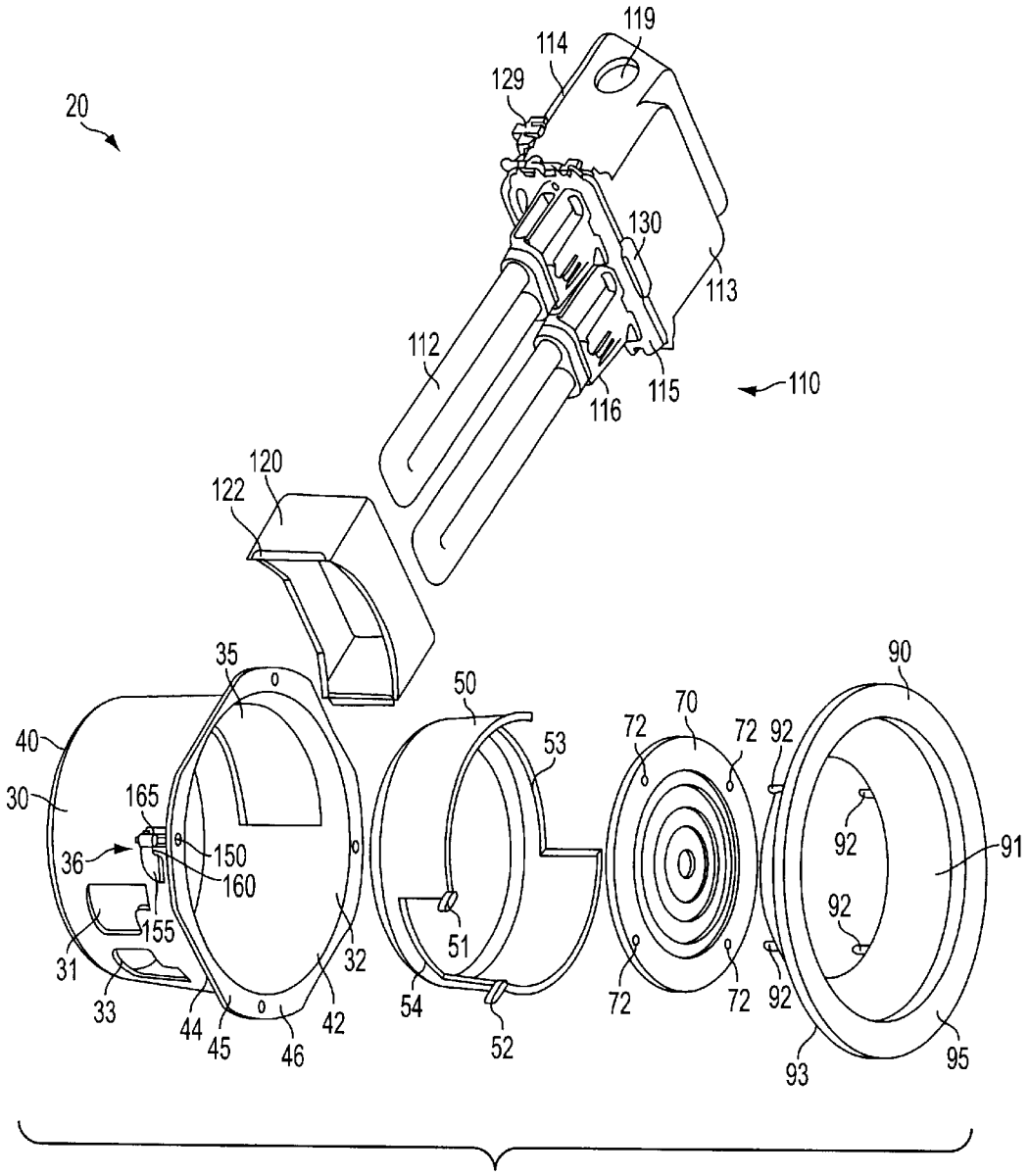
FIG. 1 is an exploded view of the light fixture of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

Figure 2:
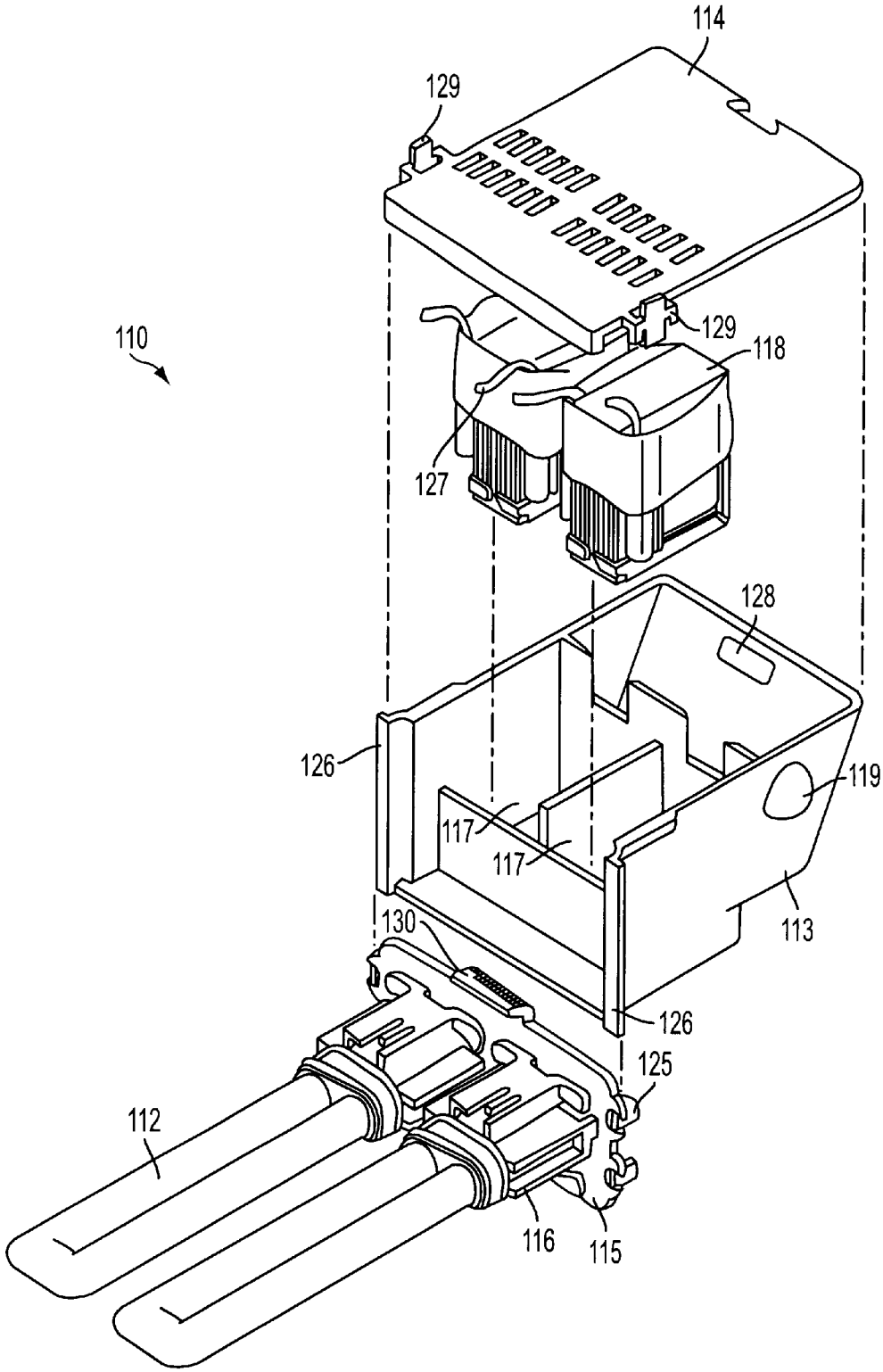
FIG. 2 is an exploded view of a lighting assembly used with the fixture of the present invention.

FIG. 1 is an exploded view of one embodiment of a light fixture of the present invention 20, such light fixture 20 generally comprising a can 30, a reflector 50, a lens 70, a decorative trim member 90, a lighting unit 110 and a socket box 120. As also shown in FIG. 2, which is an exploded view of a lighting assembly, the lighting unit 110 comprises a junction box 113 having a plurality of chambers 117 for holding electronic ballasts 118 therein. A socket plate 115 having lamp sockets 116 snapped thereto is provided with clamping fingers 125 on either side that slidingly engage rails 126 along the end of the junction box 113. Wires 127 extending from the ballasts 118 and wires extending from the lamp sockets 116 (see FIG. 9) are connected to a power source (not shown) through a cutout 119 in the side of the junction box 113. Finally, a tab 131 (see FIG. 9) on a vented cover 114 is inserted through opening 128 injunction box 113 and such cover 114 is pivoted downward and snapped into covering engagement with the junction box 113 via flexible clips 129, thereby securing socket plate 115 in position. Lamps 112 are snapped into the lamp sockets 116 of the lighting unit 110 either before or after assembly of the light fixture 20, and for purposes of illustration such lamps will always be shown in the appended drawings housed in their respective sockets 116. Although fluorescent-type bulbs and its corresponding lighting requirements are described, it will be appreciated that other types of bulbs, such as incandescent bulbs with its corresponding lighting requirements, and the like could also be used. The assembly of the light fixture will now be described.

Can 30 has a first, preferably closed end 40, a second free end 42 terminating in a flange 45 and cutouts 31, 33 and 35. Flange 45 is provided with a rear surface 44, a front surface 46 and a thickness defined therebetween. The thickness of flange 45 is not uniform but varies from approximately 1 mm to 2 mm as will be described below (see, in particular, FIG. 11). Flange 45 is preferably circumferentially dimensioned so that it will not pass through a ceiling orifice 200 (see FIG. 13) through which the light fixture of the present invention is installed. At least one, and preferably a plurality of retaining members 36 for retaining the can 30 in a ceiling location are disposed on the can 30 and preferably around the flange 45 as shown. As will be described below and more particularly in connection with FIGS. 12 and 13, can 30 is inserted from its first end 40 through a ceiling orifice from below the ceiling until the rear surface 44 of the flange 45 abuts the exposed surface of the ceiling.

Prior to or after insertion of the can 30 through a ceiling orifice, the reflector 50 is snapped into the can 30 via the engagement of the reflector tabs 51,52 with can cutouts 31, 33. The reflector 50 is flexible to allow for the deflection of the reflector tabs 51, 52 into the can cutouts 31, 33. The reflector 50 is also provided with cutouts 53, 54 on opposite sides to allow for the passage of the socket box 120 and lamps 112 therethrough. When the reflector 50 is attached to the can 30, reflector cutout 53 coincides with can cutout 35 and reflector cutout 54 coincides with can cutouts 31 and 33. As will described later, can cutouts 31 and 33 provide enough clearance to allow for the removal and replacement of lamps 112 from the lighting unit 110 while the lighting unit 110 remains attached to the can 30 and the light fixture 20 remains installed in a ceiling.

Following or before insertion of the reflector 50 into the can 30, the socket box 120 is inserted into the can 30 through the open end 42 and through cutout 35 until the peripheral lip 122 of the socket box 120 abuts the inner surface 32 of the can 30. The lighting unit 110 is then snapped into engagement with the can 30 via the socket box 120, and more particularly via the snap engagement of the clip 130 with the side of the socket box 120.

Figure 3:
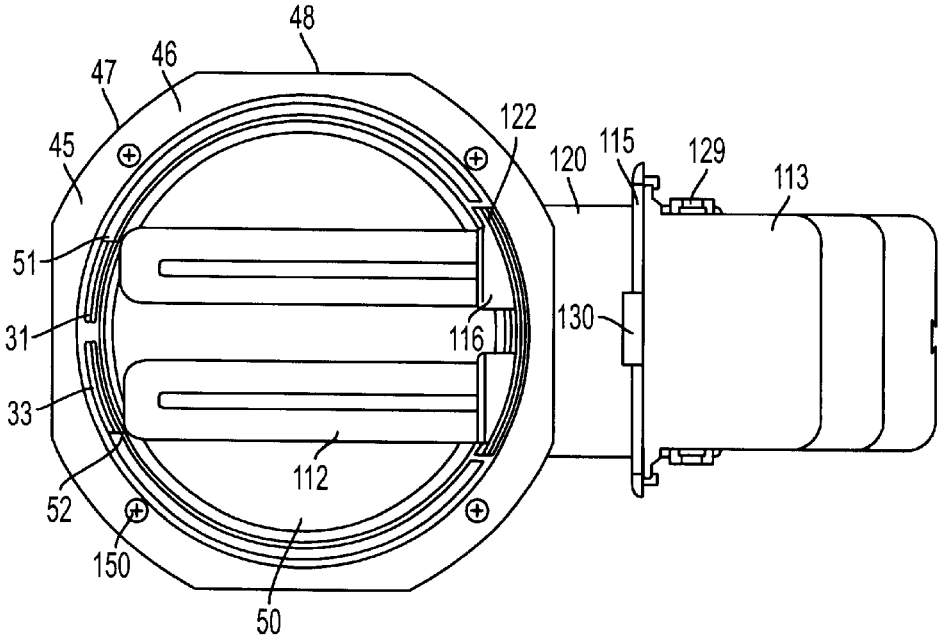
FIG. 3 is a bottom view of an assembled light fixture without attachment of a lens or decorative trim member.

FIG. 3 is a bottom view of the light fixture of the present invention assembled together, but without attachment of the lens 70 or decorative trim member 90. Normally, the lens 70 and decorative trim member 90 are not attached to the can 30 until after the can 30 has been secured to the ceiling as will be described in connection with FIGS. 12 and 13 below. This is generally because the retaining members 36, which are preferably provided in the flange 45, must be moved into their support position for supporting the can 30 in the ceiling before the flange 45 is covered by the decorative trim member 90. However, prior to describing such installation, the attachment of the trim member 90 and final assembly of the light fixture of the present invention will now be described.

Completion of the light fixture of the present invention from the embodiment shown in FIG. 3 is accomplished by snapping pegs 92 (FIG. 1) of trim member 90 into the openings 72 of lens 70 and then engaging the trim member 90 with the lens 70 already attached to the flange 45, to the can 30. When the light fixture is mounted in the ceiling as will be described in connection with FIG. 12, the inner surface 91 and outer rim 95 of the trim member 90, as well as the lens 70 and possibly the lamps 112, are viewable from below (see also the bottom view of FIG. 8). In addition, it will be appreciated that while cutouts 31 and 33 in the can 30 allow lamps 112 to be withdrawn from sockets 116 and replaced as needed, such cutouts 31, 33 may be removably covered with snap lock covers or the like (not shown) after installation if the ceiling area is to be insulated or if it is desired to seal the interior of the can 30 from the ceiling installation environment.

Figure 5:
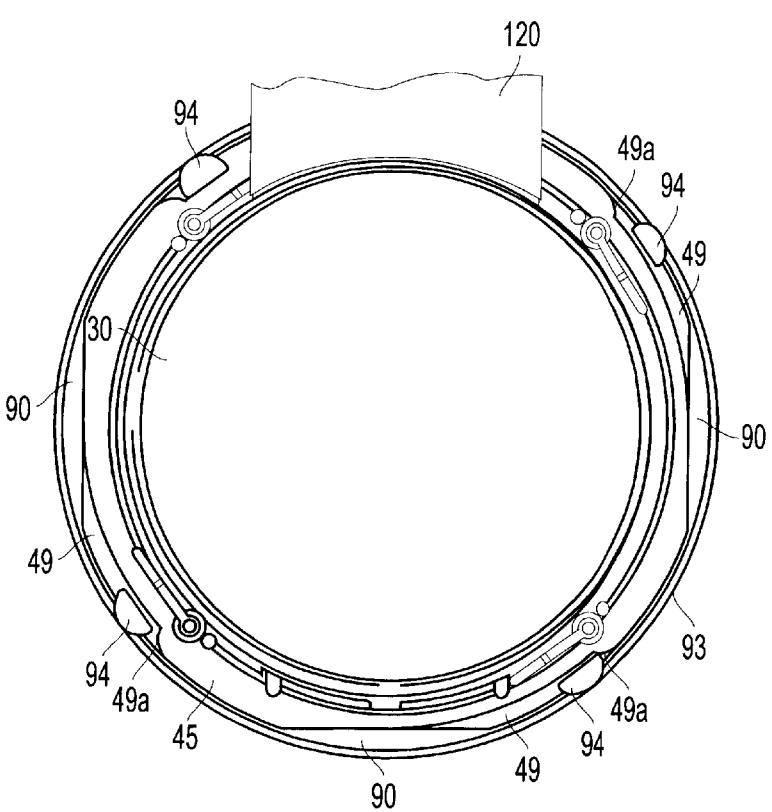
FIG. 5 is a top view of an assembled light fixture with the decorative trim member rotatingly engaged with the flange of the can.
Figure 4:
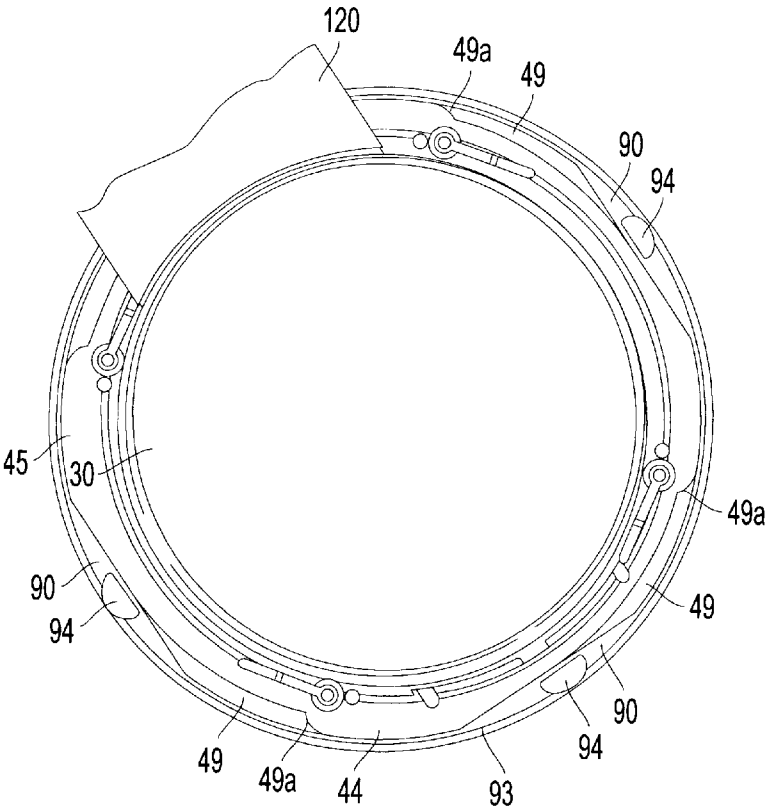
FIG. 4 is a top view of an assembled light fixture in preparation for engagement of the decorative trim member with the can and flange member.

As shown in FIGS. 4 and 5, which are top views of the light fixture prior to (FIG. 4) and after (FIG. 5) engagement of the trim member 90 with the flange 45, the decorative trim member 90 is provided with at least one, and more preferably a plurality of tabs 94 extending inwardly from the peripheral rim 93. Due to the thinness of the flange 45 as noted above, the clearance between the tabs 94 and rear surface of the trim member 90 is relatively small. As shown in FIG. 3, the peripheral edge of the flange 45 has a series of arcuate sections 47 and planar sections 48, with the front surface 46 of the flange 45 being entirely planar. The rear surface 44 of the flange 45 as shown in FIGS. 4 and 5 does not have a uniform contour, but instead is formed with ramped portions 49 carved out of the rear surface 44. Thus, the thickness of the flange 45, which will be described in detail in connection with FIG. 11, varies from approximately 2 mm to approximately 1 mm along the ramped portions 49. Initially, as shown in FIG. 4, the trim member 90 is brought into overlapping alignment with the flange 45 so that the tabs 94 are situated adjacent the planar sections 48 of the flange 45 and not securely fastened to the flange 45. Then, as seen in FIG. 5, the trim member 90 is rotated clockwise, so that the tabs 94 slide onto the ramped portions 49 along the rear surface 44 of the flange 45 until the tabs 94 encounter stops 49*a* formed by the ends of the ramped portions 49, and thus becomes securely fitted to the flange 45. Removal of the trim member 90 from the flange 45 is accomplished by a counter-clockwise rotation of the trim member 90 with respect to the flange 45.

Figure 6:
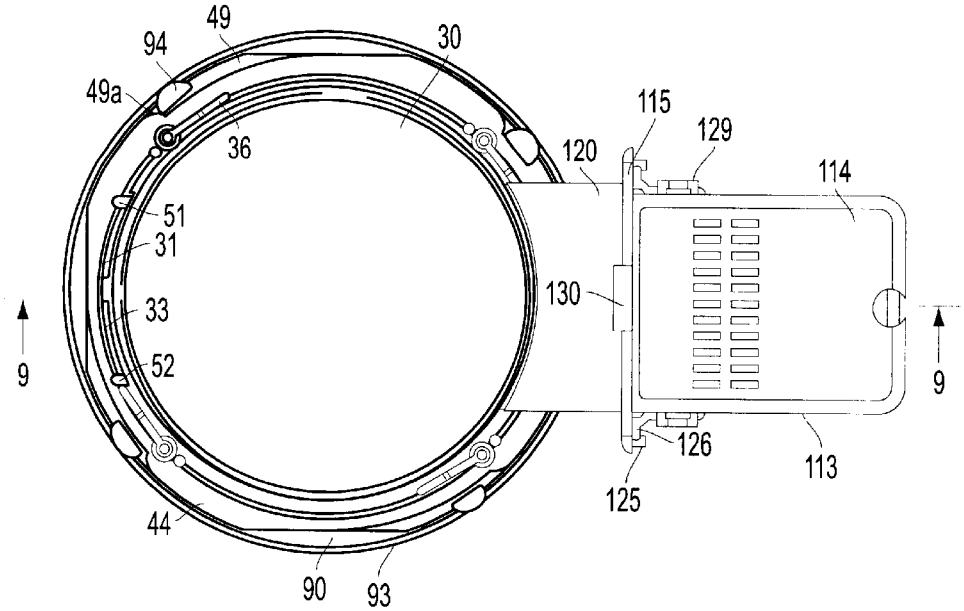
FIG. 6 is a top view of a completely assembled light fixture of the present invention.
Figure 7:
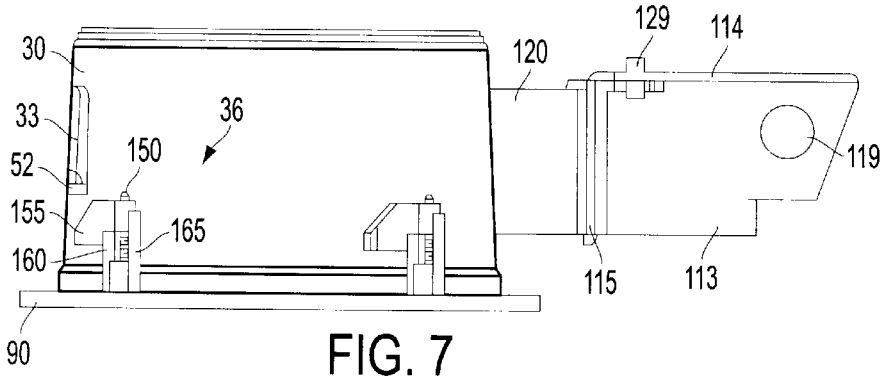
FIG. 7 is a side view of a completely assembled light fixture of the present invention.
Figure 8:
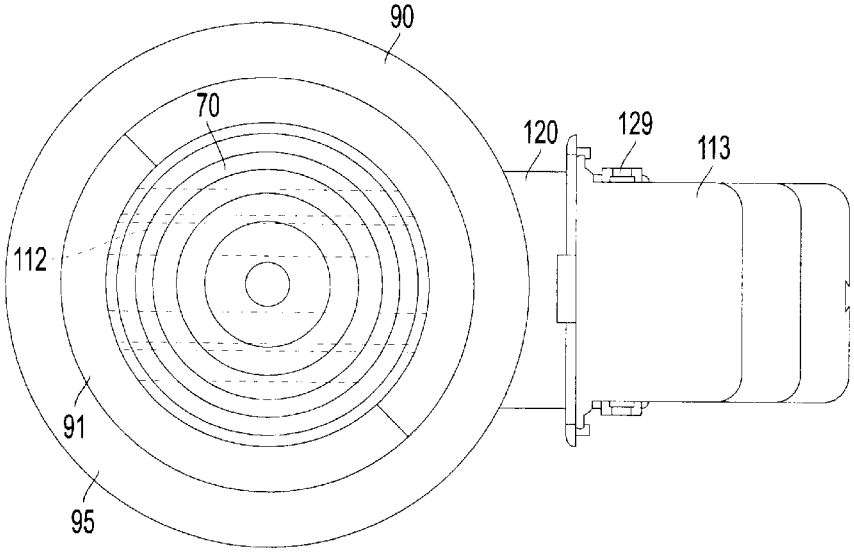
FIG. 8 is a bottom view of a completely assembled light fixture of the present invention.
Figure 9:
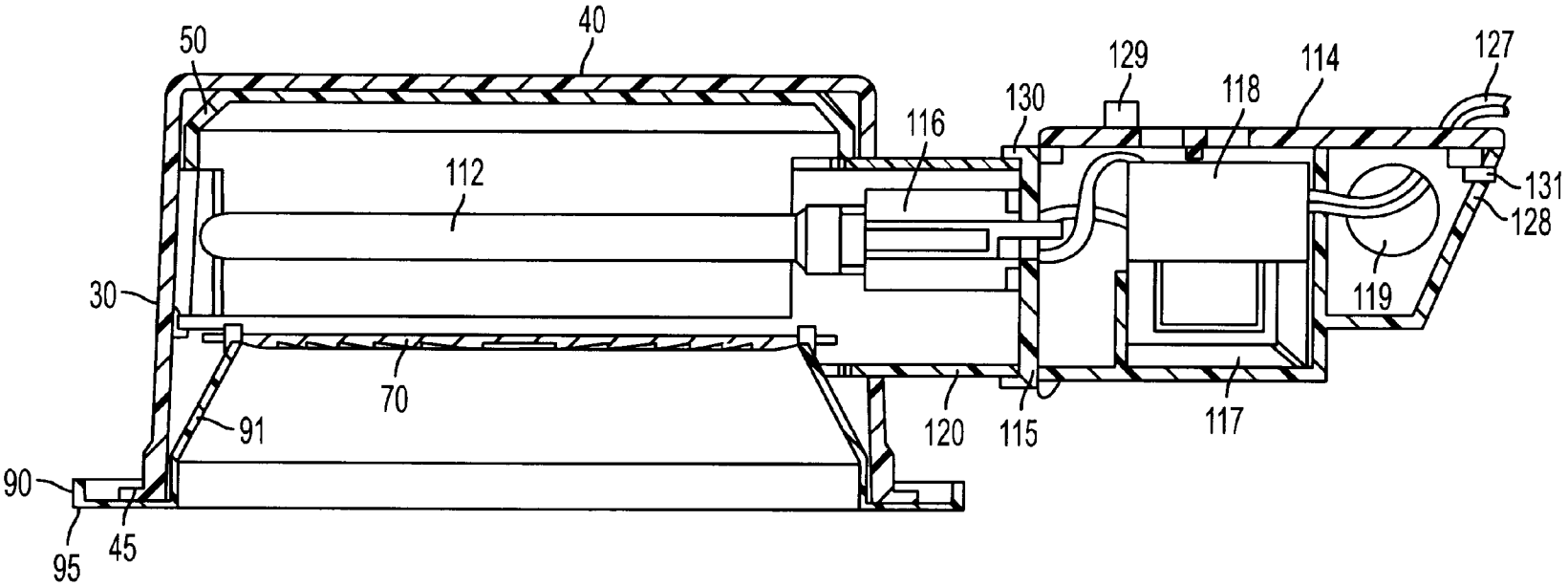
FIG. 9 is a section taken through 9—9 of FIG. 6.

FIG. 6 is a top view, FIG. 7 is a side view, FIG. 8 is a bottom view and FIG. 9 is a view taken through section 9—9 of FIG. 6 of an assembled (but not installed) light fixture of the present invention.

Figure 10:
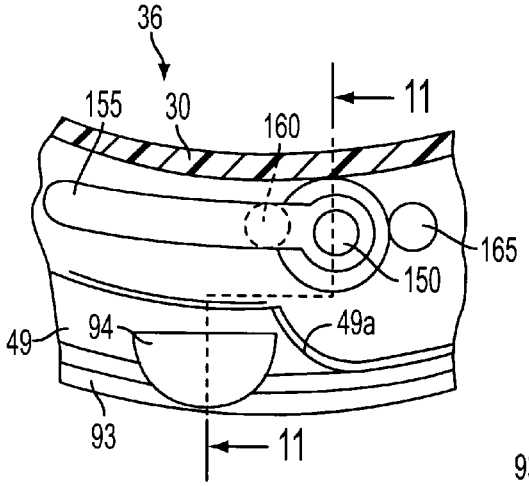
FIG. 10 is a magnified top view of a retaining member of the light fixture of the invention.
Figure 11:
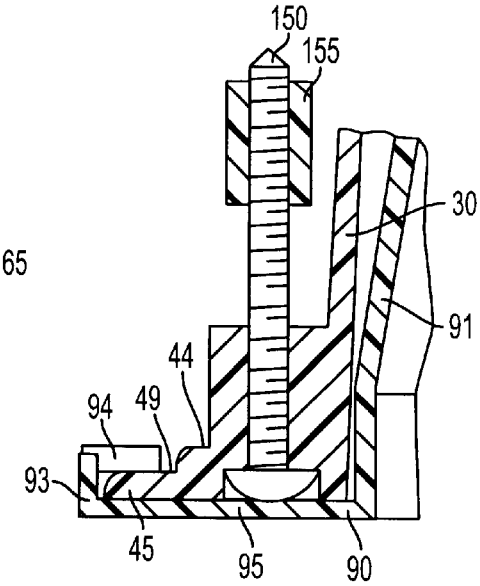
FIG. 11 is a section taken through 11—11 of FIG. 10.

FIG. 10 is a magnified view of the retaining member 36 of the present invention, and FIG. 11 is a section taken along 11—11 of FIG. 10. The retaining members 36 will now be described with reference to FIGS. 7, 10 and 11. The primary component of a retaining member 36 is a movable flag-like member 155, hereinafter referred to as a flag 155, threaded on a threaded fastener 150, which threaded fastener 150 has been passed through flange 45 (see also FIG. 3). Flag 155 is positioned between a short post 160 and a tall post 165. Initially, flag 155 is positioned directly over the shorter post 160 as shown in FIGS. 7 and 10 and lies adjacent can 30. Initially, flag 155 is also positioned such that it does not extend beyond the peripheral edge of the flange 45. There is a tight engagement between the flag 155 and fastener 150 so that the flag 155 turns with the fastener 150 when the flag 155 is not abutting one of the posts 160, 165 or the can 30. Counter-clockwise (fastening) rotation of the threaded fastener 150 via the flange 45 (see also FIGS. 1 and 3) causes the flag 155 to rotate counter-clockwise with the fastener until the flag 155 abuts post 165 (see FIGS. 12 and 13, which will be described below) and extends beyond the periphery of the flange 45. Continued rotation of the threaded fastener 150 while abutting post 165 causes the flag 155 to thread or move downwardly along the fastener 150 until the flag 155 engages the ceiling as will also be described below. Clockwise rotation of the fastener 150 causes flag 155 to rotate with the fastener 150 clockwise until such flag 155 abuts shorter post 160. Continued clockwise rotation of the threaded fastener 150 causes the post-abutting flag 155 to thread or move upwardly until the flag 155 clears the post 160, at which point the flag 155 continues a clockwise rotation with the fastener 150 until the flag 155 clears the periphery of the flange 45 and lies adjacent the can 30 as shown in FIGS. 7 and 10.

FIG. 11 also illustrates the variation in thickness along the rear surface 44 of the flange 45. As discussed in connection with FIGS. 4 and 5, the trim member 90 engages the flange 45 through the movement of the trim member tabs 94 along the ramped portions 94 of the flange 45. The ramped portions 94 represent a reduction in thickness in the rear surface 44 of the flange 45, which rear surface 44 abuts the exposed side 215 of the ceiling 210 (see FIG. 12) during installation thereof. As also shown in FIG. 11, the thickness of the tabs 94 on the trim portion plus the thickness of the ramped sections 94 is substantially the same as the thickness of the rear surface 44 of the flange 45. The greater thickness of the rear surface 44 of the flange 45, as compared with the lesser thickness of the ramped portions 94, also coincides with the thickness of the peripheral edge 93 of the trim member 90. Thus, when the decorative trim member 90 is attached to the flange 45 as described in connection with FIGS. 4 and 5, the tabs 94 are able to engage the ramped portions 94 of the flange without interference from the exposed side 215 of the ceiling 210 (FIG. 12), while the peripheral edge 93 of the trim member 90 has a sufficient thickness to hide such engagement and at the same time cleanly abut the exposed side 215 of the ceiling 210 (FIG. 12) as well. Consequently, the thickness dimensions of the rear surface of the flange and the ramped portions, as well as the tabs and the peripheral edge of the trim member, results in a secure engagement between the trim member and the flange that is cleanly and neatly hidden from view by the peripheral edge of the trim member.

Figure 12:
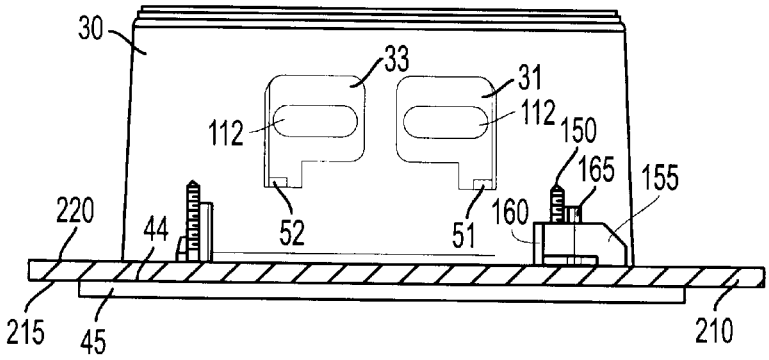
FIG. 12 is a front view of a partially assembled light fixture secured to a ceiling, the ceiling being shown in section.
Figure 13:
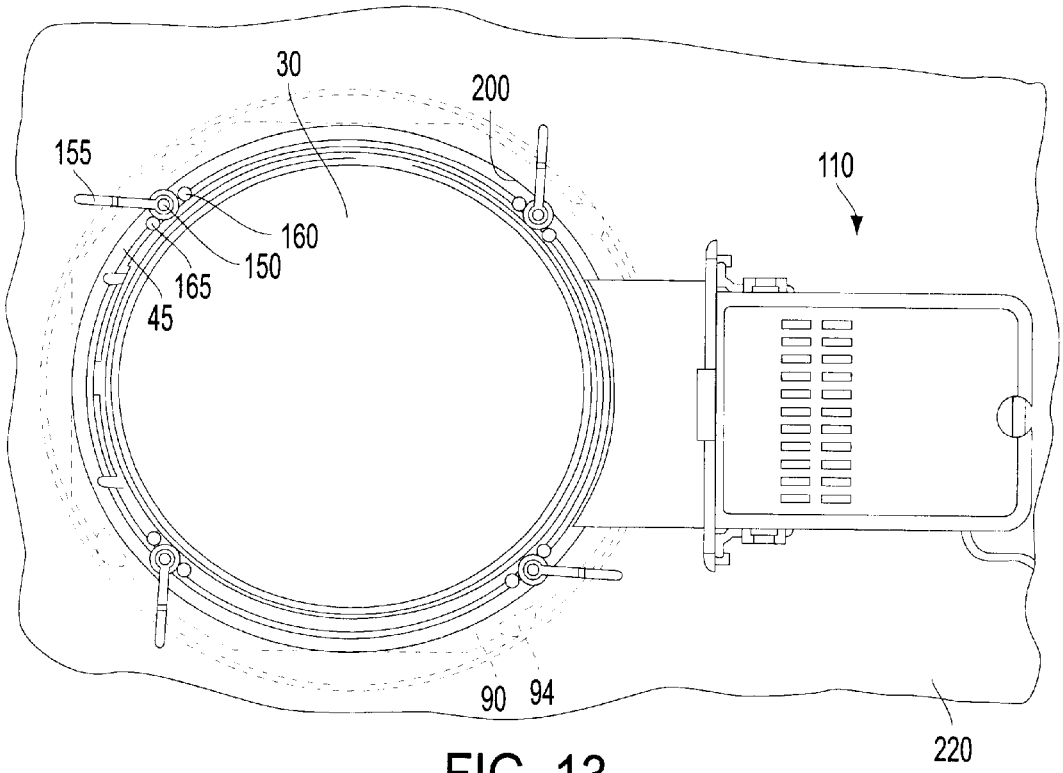
FIG. 13 is a top view of a completely assembled light fixture secured through an orifice in the ceiling with the decorative trim member and portions of the flange being hidden by the ceiling and shown using dotted lines.

Installation of the light fixture will now be described in connection with the previous figures and further in connection with FIGS. 12 and 13. The light fixture is initially assembled to the extent shown in FIG. 3, i.e., without attachment of the lens 70 or decorative trim member 90. Such partially assembled light fixture is then inserted lighting unit 110 first through an orifice 200 in the ceiling 210 until the flange 45, and more particularly the rear surface 44 thereof, abuts the exposed surface 215 of the ceiling 200. Flange 45 is dimensioned to prevent complete or over insertion of the light fixture through the ceiling orifice 200. Once flange 45 has been positioned against the exposed surface 215 of the ceiling 210, threaded fasteners 150 are tightened until flags 155 abut posts 165, thereby extending beyond the periphery of the ceiling orifice 200, and continued tightening of the fasteners 150 causes the flags 155 to move downward until such flags 155 clamp the unexposed surface 220 of the ceiling as shown in FIG. 12, thereby securing the can 30 and attached lighting unit 110 to the ceiling 210. Once the can 30 and attached lighting unit 110 have been secured to the ceiling 210, the decorative trim member 90 with attached lens 70 is inserted into the free end 42 of the can 30 and rotatingly and securely engaged with flange 45 through the movement of tabs 94 along ramped portions 49 as previously described in connection with FIGS. 4, 5 and 11. Later removal of the trim member 90 from the secured light fixture is as easy as rotating the trim member 90 in the opposite direction so that tabs 94 become aligned with the planar portions 48 of the flange 45 as shown in FIG. 4. Later withdrawal of the light fixture from the ceiling 210 through the ceiling orifice 200 is also as easy as rotating the threaded fasteners 150 until each flag 155 lies adjacent the can 30 and no longer extends beyond the periphery of the ceiling orifice 200.

It should be appreciated that the light fixture of the present invention is secured directly to the ceiling via retaining members, and does not require attachment to a support beam or the like, which support beam may or may not be present in a desired lighting location. It should also be appreciated, as particularly discussed with respect to FIG. 11, that the thinness of the flange and the relative thinness of the trim tabs and peripheral edge of the decorative trim member allows the decorative trim member to securely engage the flange and lie flush against the exposed ceiling surface after engagement.

It should also be appreciated that most of the components that form the lighting fixture are snap engageable. In fact, it is only during the rotation of the retaining members in the embodiment described above that an external tool is required. For example, it is conceivable that the threaded fasteners 150 could be provided with a hand-manipulatable head, such as a wing nut or the like, instead of a head designed for engagement by a screwdriver or the like.

The ease with which the entire lighting fixture snaps together also allows for variations in the aesthetic (viewable) components, namely the trim member and the lens. For example, instead of using a lens 70 described in the above embodiment and shown in FIG. 14, which lens 70 is provided within a plurality of concentric ridges and a contoured surface, it might be desired to use lens 70*a* of FIG. 15, which has a convex shape and a relatively smooth surface. Changing between lenses 70 and 70*a*, or any other lens configuration desirable, is as easy as snapping such lenses into pegs 92 as shown in FIGS. 14 and 15 and as described above.

Alternatively, if it is desired to vary the appearance of the inner surface 91 of the trim member 90 as discussed in connection with FIGS. 1–15, it might be preferable instead to use the lens 170, inner liner 180 and trim member 190 of FIGS. 16–18. The inner liner 180 snaps into engagement with the decorative trim member 190 via tabs 182 so that the inner liner 180 is flush with the trim member 190, and the lens is then snapped into engagement with the inner liner 180. The inner liner 180 of FIGS. 16 and 17 is provided with a series of concentric ridges, while the inner liner 1 80a of FIG. 18 is provided with a reflective surface. Even though the appearance of the inner surface of the trim member is varied, the trim member 190 still engages the flange through the use of tabs as discussed above.

Thus, once the basic lighting assembly of FIG. 3, for example, is initially secured to the ceiling as shown in FIG. 12, the consumer is provided with a variety of aesthetic components, i.e. lenses, liners and/or trim members, that are easily attachable to such lighting assembly and easily removable therefrom. The consumer can change trim members and/or inner liners and/or lenses fairly effortlessly and without removing the basic lighting assembly from the ceiling.

Figure 14:
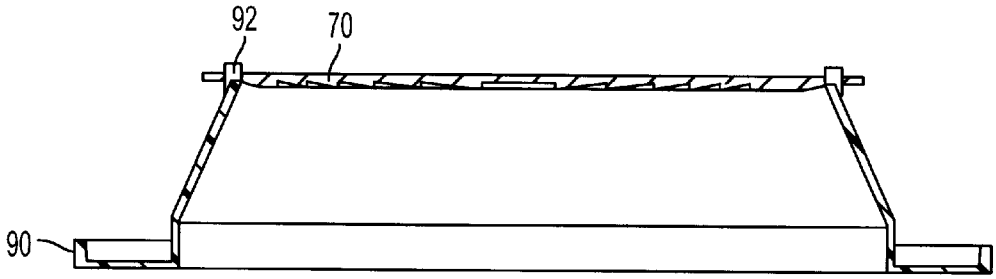
FIG. 14 is a sectional view of a lens attached to a decorative trim member.
Figure 15:
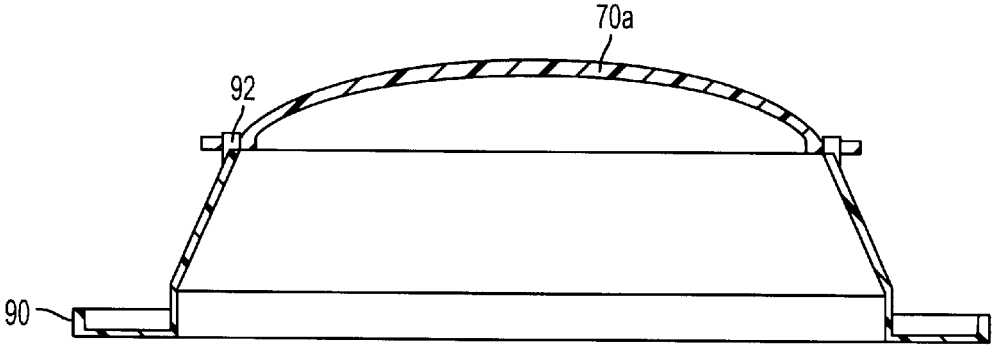
FIG. 15 is a section view of an alternative lens attached to the decorative trim member of FIG. 14.
Figure 16:
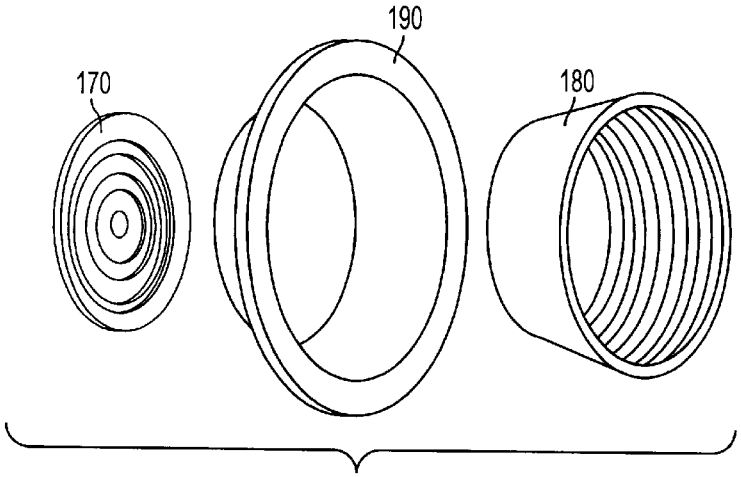
FIG. 16 is an exploded view of an alternative decorative trim assembly.
Figure 17:
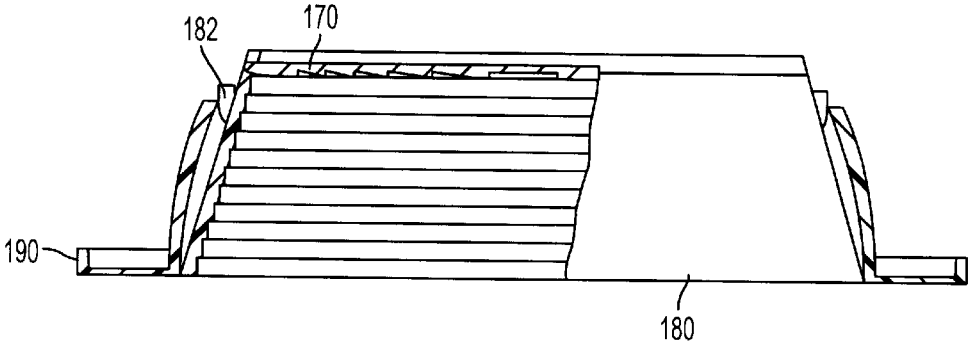
FIG. 17 is a partial sectional view of the assembled decorative trim member of FIG. 16.
Figure 18:
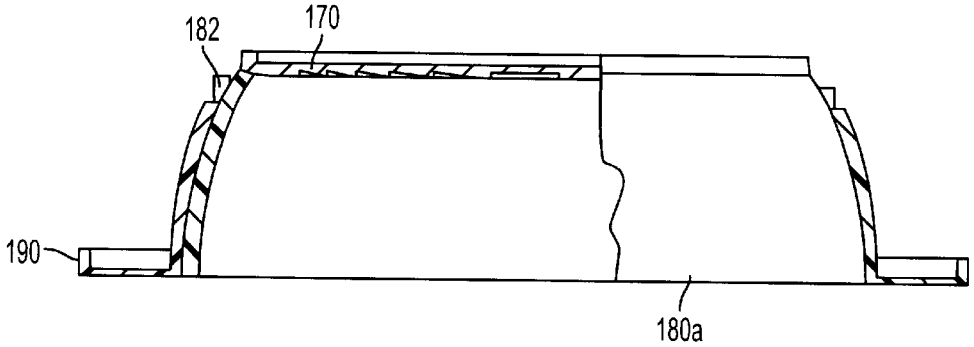
FIG. 18 is a partial section view of an assembled decorative trim member having an alternative inner surface member.

It should be appreciated that while the aesthetic components of FIGS. 14 and 15 have different constructions from the components of FIGS. 16–18, such components could be designed to be interchangeable. For example, the inner liners 180 and/or 180*a* of FIGS. 16–18 could be provided with pegs while the lenses 170 could be provided with holes through which such pegs are insertable, so that the engagement of the lenses and liners of such figures is similar to the engagement of the lenses and trim members of FIGS. 14 and 15. In other words, the lens 170 of FIG. 17 could be constructed to engage with trim member 90 of FIG. 14, and vice versa.

Furthermore, while the engagement of the flange and the trim member has been described through the use of tabs present in the trim member that ride along ramped portions present in the flange member, also known as a bayonet-type lock, alternative ways of engaging the trim member and the flange member may be employed. For example, the flange might be provided with an engagement projection or a series of engagement projections while the trim member might be provided with one or a series of slots that are engaged by said projections upon relative rotation of the flange with the trim member. Alternative constructions that provide for easy engagement and disengagement of the trim member with the flange member, and that provide for interchangability between a variety of aesthetic components, may be devised.

Therefore, while the present invention has been described at some length and with some particularity with respect to the several described embodiments, it is not intended that it should be limited to any such particulars or embodiments or any particular embodiment or construction, but it is to be construed with references to the appended claims so as to provide the broadest possible interpretation of such claims in view of the prior art and, therefore, to effectively encompass the intended scope of the invention.

We claim:

1. A down light fixture for installation through an orifice in a ceiling from its exposed side, said orifice extending between an exposed surface that is viewable from below and an unexposed surface, said light fixture comprising:

a) a can adapted to receive a lighting unit, said can having a first end substantially positionable in said ceiling through said orifice and a second end having a flange adjacently positionable against said exposed surface of the ceiling about said orifice, b) retaining members disposed on said can for retaining said can in said ceiling, said retaining members being accessible through said can from the exposed side of said ceiling, c) a decorative trim member rotatingly, removably and securely engageable with said flange to provide an exterior trim to the fixture, d) a reflector removably snap engageable with said can, and e) a lens removably snap positionable to said decorative trim member and engageable with said can by said decorative trim member, f) wherein said decorative trim member further comprises a rim portion engageable with said flange and an inwardly curved, reflective surface extending continuously from said rim portion and connected to said lens.

2. A down light fixture in accordance with claim 1, wherein said decorative trim member further comprises at least one tab engaging said flange.

3. A down light fixture in accordance with claim 2, wherein said decorative trim member has a contoured inner surface.

4. A down light fixture in accordance with claim 2, wherein said decorative trim member has a smooth inner surface.

5. A down light fixture in accordance with claim 1, wherein said retaining members are movable from an insertion position lying adjacent said can for installation and insertion of said can through said orifice, to a support position extending outwardly from said can to prevent said can from falling through said orifice.

6. A down light fixture in accordance with claim 5, wherein said retaining members are adapted for clamping engagement against said unexposed surface of the ceiling in said support position.

7. A down light fixture in accordance with claim 2, wherein said lighting fixture is supported by said retaining members solely by the clamping engagement of said retaining members against said unexposed surface of said ceiling.

8. A down light fixture in accordance with claim 1, wherein said lighting unit further comprises at least one lamp socket connected to a junction box, said junction box adapted to receive and convey power to said at least one lamp.

9. A down light fixture in accordance with claim 8, wherein said lamp sockets are adapted for snap engagement with said junction box.

10. A down light fixture in accordance with claim 1, wherein said lens and said decorative trim member are replaceable with respect to said can while said light fixture is installed in the ceiling.

11. A down light fixture in accordance with claim 2, wherein said flange has a front surface, a rear surface and a thickness defined therebetween, said front surface being exposed and said rear surface being positioned adjacent said exposed surface of the ceiling when said can is installed in the ceiling.

12. A down light fixture in accordance with claim 11, wherein said thickness is non-uniform.

13. A down light fixture in accordance with claim 11, wherein said flange further comprises at least one engagement section for engagement by said at least one tab of said decorative trim member.

14. A down light fixture in accordance with claim 13, wherein said at least one engagement section is provided on the rear surface of said flange.

15. A down light fixture in accordance with claim 14, wherein said at least one engagement section further comprises at least one ramped section upon which said at least one tab is moveable during engagement of said decorative trim member with said flange.

16. A down light fixture in accordance with claim 11, wherein said thickness varies from between 1–2 mm.

17. A down light fixture in accordance with claim 1, wherein said retaining members are disposed on said flange.

18. A down light fixture for installation through an orifice in a ceiling from its exposed side, said orifice extending between an exposed surface that is viewable from below and an unexposed surface, said light fixture comprising:

a) a can adapted to receive a lighting unit and provided with a flange disposed along a free end of said can, b) said flange being dimensioned to abut the exposed side of the ceiling to prevent the over-insertion of said can into said ceiling, c) a decorative trim member rotatingly, removably and securely engageable with said flange to provide an exterior trim to the fixture, d) retaining members disposed on said can for retaining said can in said ceiling, said retaining members being accessible through said can from the exposed side of said ceiling, e) wherein said retaining members are rotatable from an insertion position lying adjacent said can for installation and insertion of said can through said orifice, to a support position extending outwardly from said can to prevent said can from falling through said orifice, f) wherein said can further comprises a pair of guide members associated with each retaining member, each of said guide members being positioned with respect to said retaining member to respectively maintain said retaining member in said insertion position and said support position, and g) wherein said decorative trim member further comprises a rim portion and a continuous reflective surface extending from said rim portion and terminating in a lens portion.

* * * * *